US008523127B1

(12) United States Patent
Bennett

(10) Patent No.: US 8,523,127 B1
(45) Date of Patent: Sep. 3, 2013

(54) HOLDING APPARATUSES FOR ATTACHMENT TO CHAIN LINK FENCES

(76) Inventor: Monte W. Bennett, Huntsville, AL (US)

( * ) Notice: Subject to any disclaimer, the term of this patent is extended or adjusted under 35 U.S.C. 154(b) by 0 days.

(21) Appl. No.: 13/362,965

(22) Filed: Jan. 31, 2012

Related U.S. Application Data

(60) Provisional application No. 61/437,961, filed on Jan. 31, 2011.

(51) Int. Cl.
*A47B 96/00* (2006.01)
*A47K 1/00* (2006.01)
*A47K 5/00* (2006.01)

(52) U.S. Cl.
USPC ..... 248/222.52; 248/223.41; 248/224.8; 248/225.11; 248/309.1; 211/85.7; 211/86.01; 211/89.01

(58) Field of Classification Search
USPC ..... 211/60.1; 248/304, 220.21, 222.51, 248/222.52, 223.41, 224.8, 225.11
See application file for complete search history.

(56) References Cited

U.S. PATENT DOCUMENTS 4,049,126 A * 9/1977 Halverson ..... 211/104
4,340,144 A * 7/1982 Cousins ..... 211/106.01
4,582,284 A * 4/1986 Veenstra ..... 248/220.21
4,629,065 A * 12/1986 Braaten ..... 206/315.1
4,953,817 A 9/1990 Mosteller
5,582,377 A 12/1996 Quesada
5,626,244 A * 5/1997 Mesna et al. ..... 211/60.1
D417,807 S * 12/1999 McBarnette ..... D6/513
6,029,830 A 2/2000 Manookian
6,669,175 B2 * 12/2003 Snow et al. ..... 256/32
7,090,085 B1 * 8/2006 Vicendese et al. ..... 211/106.01
D560,088 S * 1/2008 Tracy ..... D6/552
7,887,027 B2 * 2/2011 Garceau et al. ..... 256/1
2010/0282935 A1 11/2010 Zannoni
2011/0100939 A1 * 5/2011 Friesch ..... 211/85.7

* cited by examiner

*Primary Examiner* — Amy J Sterling

(74) *Attorney, Agent, or Firm* — Maynard Cooper & Gale, P.C.; Jon E. Holland

(57) ABSTRACT

Apparatuses for holding sport's equipment or other articles to a chain link fence are described. The apparatuses provide sport's participants and spectators with a convenient place for holding articles. A hub of an apparatus is aligned within an opening of a chain link and thereafter rotated for securing the hub to wires of the chain link fence. The apparatus is removed when the hub is rotated in the reverse direction and pulled from the fence. A variety of article holders may extend from the hub so that there are apparatuses for holding a bat, a cup, or other articles.

6 Claims, 8 Drawing Sheets

HOLDING APPARATUSES FOR ATTACHMENT TO CHAIN LINK FENCES

CROSS REFERENCE TO RELATED APPLICATION

The present disclosure claims priority to U.S. Provisional Patent Application No. 61/437,961, entitled "Holding Apparatuses for Attachment to Chain Link Fences," and filed on Jan. 31, 2011, which is incorporated herein by reference.

BACKGROUND

At neighborhood baseball fields and other sports facilities, it is often desirable to hang baseball equipment, such as, bats, gloves and helmets, from a fence of a dugout for easy retrieval. In addition, spectators and participants present at baseball games or similar sporting events often consume beverages as they watch or participate. At such times, it would be convenient if a drink container, such as a cup, a drink can or a drink bottle could be similarly hung from a fence within or near a dugout.

Chain link fences are typically found at fields and other areas where sporting events occur. The fabric of a chain link fence has diamond-shaped cells formed by intertwining wires that make up the chain link fence, and the fabric of the chain length fence is typically held in place by fence posts and rails. Because a chain link fence is rugged and sturdy, there have been a variety of devices that persons have developed to hold equipment and drinks to a chain link fence. It is generally desirable for such devices to be securely attached to a chain link fence during use, yet easily removable from the fence after use.

DESCRIPTION OF THE DRAWINGS

The disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION

The present disclosure generally pertains to holding apparatuses that can be easily attached to and removed from a chain link fence. In this regard, chain link fences can be found at a variety of locations, such as amateur sporting fields or courts for baseball, softball, football, tennis, soccer, and other sports. At such sports venues, players bring jackets, hats, and other clothing in addition to sporting equipment such as bats, catcher masks, gloves, tennis rackets, and other items. Holding apparatuses in accordance with the present disclosure may be used to hang such articles from a chain link fence, as will be described in more detail below.

In one exemplary embodiment, a holding apparatus has a hub that is adapted for insertion into a fabric of a chain link fence. The hub has grooves into which wires of a chain link fence are inserted as the hub is rotated, thereby securing the hub to the fence. To attach the holding apparatus to a chain link fence, the hub is aligned with a cell of a chain link fence such that the hub fits within and can be inserted into the cell. After insertion of the hub into the cell, the hub is rotated such that the wires of the fence are gripped by surfaces that form the grooves of the hub. Insertion of the wires into such grooves secures the hub to the fence. To remove the holding apparatus from the fence, the hub is rotated such that the wires move out of the grooves thereby releasing the hub from the fence. The hub may thereafter be pulled out of the cell into which it was previously inserted.

Figure 1:
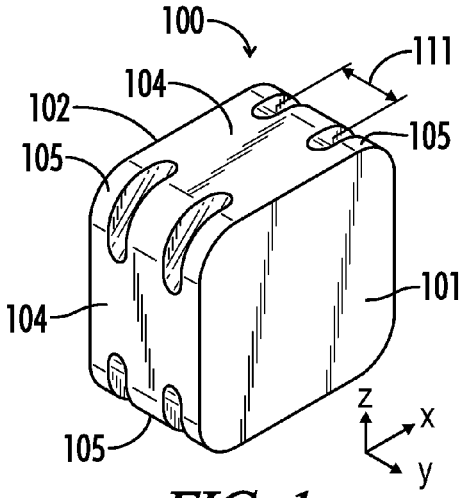
FIG. 1 depicts an exemplary embodiment of a hub attachable to a chain link fence.
Figure 2:
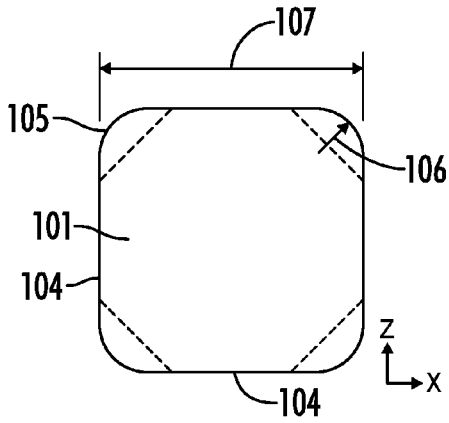
FIG. 2 depicts a front view of the hub of FIG. 1.
Figure 4:
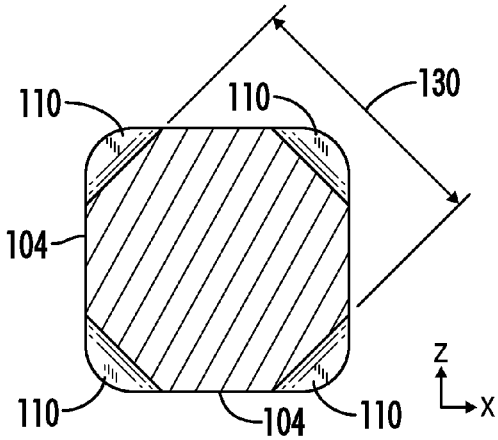
FIG. 4 depicts a cross-sectional view of the hub of FIG. 1.

An exemplary embodiment of a hub 100 attachable to a chain link fence is depicted in FIG. 1. The hub 100 as seen in FIG. 1 has a generally square shape with side corners 105. The hub 100 has a front surface 101, a back surface 102, and four side surfaces 104. The side corners 105 are formed by the intersection of side surfaces 104 and are rounded with a corner radius 106. Hub 100 has a front groove 110 and a back groove 120 in each side corner 105. Each front groove 110 is offset 111 (measured in the y-direction) from its respective back groove 120. The value of the offset 111 corresponds to the offset of wires that define a cell of a chain link fence as will be described herein. The front groove 110 and back groove 120 at each side corner 105 are parallel and are orthogonal to grooves in adjacent side corners 105. The grooves 110, 120 extend diagonally between side surfaces 104 at an angle of around 45 degrees as depicted in FIG. 2 and FIG. 4. The width of each of the grooves 110, 120 is slightly greater than the width of the respective wire on which they attach. The hub 100 can be easily attached and removed from many conventional chain link fences having intertwined wires that form diamond-shaped openings, referred to herein as "cells" as seen in FIG. 5.

The size and shape of the hub 100 are selected to allow the hub 100 to fit into a cell of a chain link fence. The size of the hub 100 is dependent on the size of the cell into which the hub 100 is to be inserted. In general, a large number of chain link fabrics have cells that are dimensioned such that opposite sides of a cell are separated by around 2.25 inches, but other dimensions of the cell are possible in other embodiments.

Figure 3:
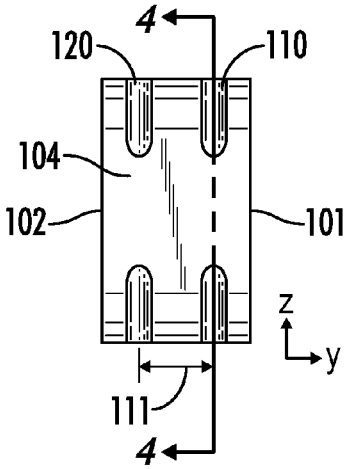
FIG. 3 depicts a side view of the hub of FIG. 1.

A front view of hub 100 depicted in FIG. 2 shows the square shape of the hub 100. The hub 100 has a width 107 of approximately 2.0 inches. Each side corner 105 of the hub 100 is rounded with a corner radius 106 of approximately 0.375 inches. A side view of the hub 100 depicted in FIG. 3 shows the location of the front grooves 110 with respect to the back grooves 120. The grooves 110 and 120 are formed in surfaces of the hub 100 and run diagonally at the hub side corners 105. In one exemplary embodiment, each groove has an opening width of around 0.188 inches, but other sizes are possible in other embodiments. The opening width is selected to be slightly greater than the diameter of the chain link fence wires such that the wires fit snugly into the grooves when the hub 100 is secured to the fence, as will be described in more detail below. The front grooves 110 are offset, measured from center to center 111 of the grooves, from the back grooves 120 by around 0.563 inches. That is, a front groove 110 at a given corner of the hub 100 is separated from the back groove 120 at the same corner by around 0.563 inches. Further, the grooves 110 and 120 in opposite side corners 105 are parallel and in adjacent side corners 105 the grooves 110 and 120 are orthogonal. FIG. 4 depicts a groove separation 130 of around 2.000 inches between grooves on opposite side corners 105 of the hub 100. For the embodiment of the hub 100 of FIG. 1, there are a total of 8 grooves in the hub (4 front grooves 110 and 4 back grooves 120).

Figure 5:
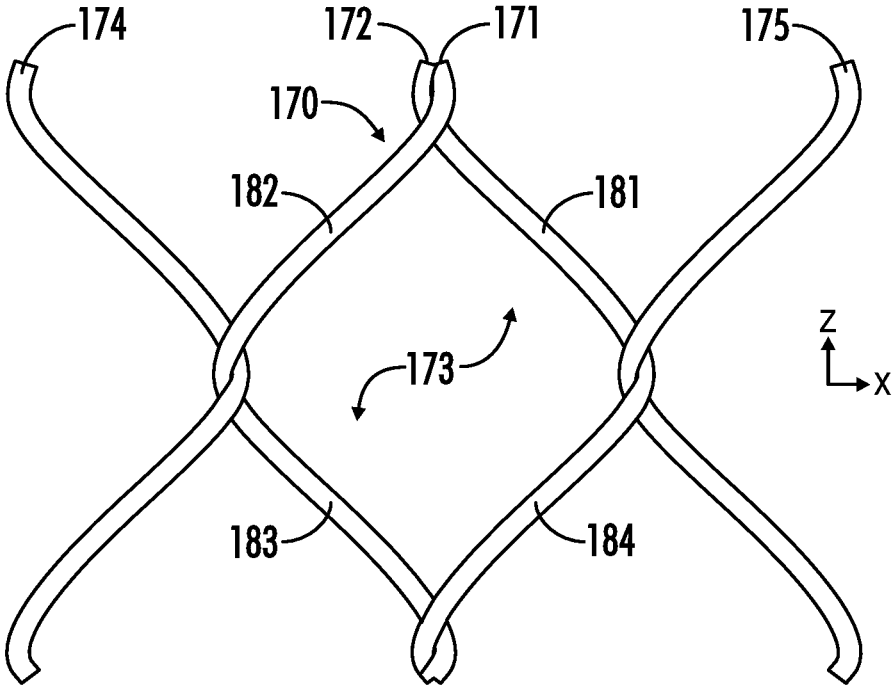
FIG. 5 depicts an exemplary structure of a fabric of a chain link fence.

FIG. 5 depicts a typical fabric of a chain link fence having cells in which each cell is defined by a pair of intertwined wires, which are also typically intertwined with wires of other cells. As an example, FIG. 5 shows a cell 170 of a chain link fence. The cell 170 is defined by a pair of wires 171 and 172 that form an opening 173 into which a hub 100 may be inserted, as will be described in more detail below. The wires 171 and 172 are also intertwined respectively with other wires 174 and 175 at the sides of the cell 170.

The cell 170 is generally diamond-shaped. Such shape is formed by four wire segments 181-184 in which segments 182 and 183 are from the same wire 171 and segments 181 and 184 are from the same wire 172. Segments 181 and 183 are parallel, and segments 182 and 184 are parallel. Further, the segments 181 and 183 are substantially orthogonal to the segments 182 and 184. In addition, the segments 181 and 183 are offset relative to the segments 182 and 184. That is, a plane of the segments 181 and 183 is separated by a plane of the segments 182 and 184, though the two planes are parallel to one another. In the embodiment shown by FIG. 5, the segments 182 and 184 are closer to the viewer than the segments 181 and 183. However, in other embodiments, it is possible for the orientation of the fence to be reversed such that the segments 181 and 183 are closer to the viewer than the segments 182 and 184. Having both a front groove 110 and a back groove 120 at each corner of the hub 100 allows the hub 100 to accommodate either orientation of wires of a chain link fence.

Figure 6:
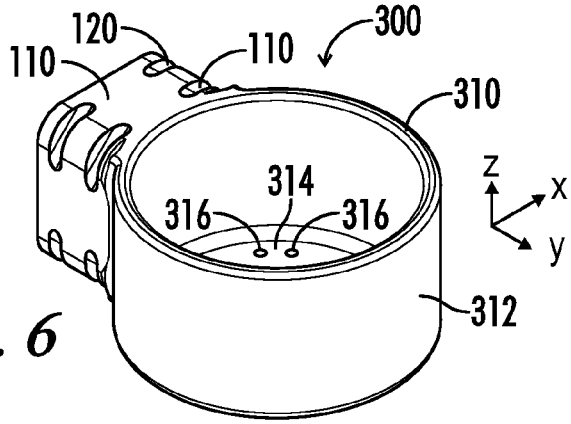
FIG. 6 depicts an exemplary embodiment of a holding apparatus for holding a drink container or other object.

FIG. 6 depicts an exemplary embodiment of a holding apparatus 300 for holding a drink container, such as a cup or bottle. The holding apparatus 300 comprises a hub 100 coupled to a drink holding element 310. The drink holding element 310 comprises an open cylinder 312 and a bottom disk 314. The disk 314 has holes 316 for allowing passage of fluids, such as spilled beverages or rain water. The open cylinder 312 is dimensioned to contain cups and a variety of beverage containers. The components of the holding apparatus 300 may form a unitary structure or may be defined by separate structures that are attached to one another.

Figure 7:
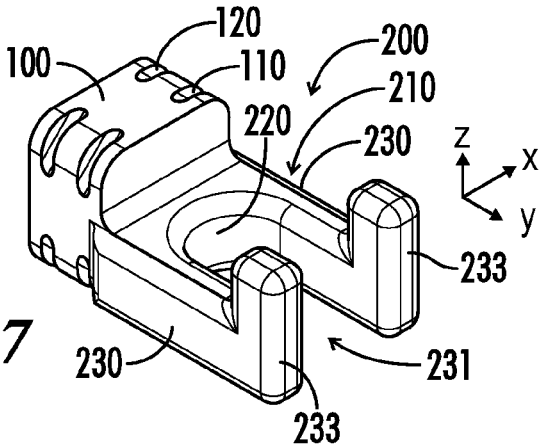
FIG. 7 depicts an exemplary embodiment of a holding apparatus for holding a bat or other object.

FIG. 7 depicts an exemplary embodiment of a holding apparatus 200 for holding a bat. The holding apparatus 200 comprises a hub 100 coupled to a bat holding element 210. In one exemplary embodiment, the hub 100 and bat holding element 210 are a unitary structure that is formed by a molding process or other manufacturing process. However, it is possible for the hub 100 to have a structure separate from that of the bat holding element 210. As an example, the bat holding element 210 may be screwed to the hub 100.

Referring to FIG. 7, the bat holding element 210 is a U-shaped structure having a pair of parallel arms 230 (extending from the hub 100 in the y-direction) separated by a gap 231. The end of each arm 230 has a retaining tab 233 pointing upward (the z-direction). Surfaces of the bat holding element 210 form a notch 220 for holding a bat or other equipment. The retaining tabs 233 at the ends of the arms 212 keep a bat from slipping off the bat holding element 210. The retaining tabs 233 may also be used for attaching other equipment to the fence.

Figure 8:
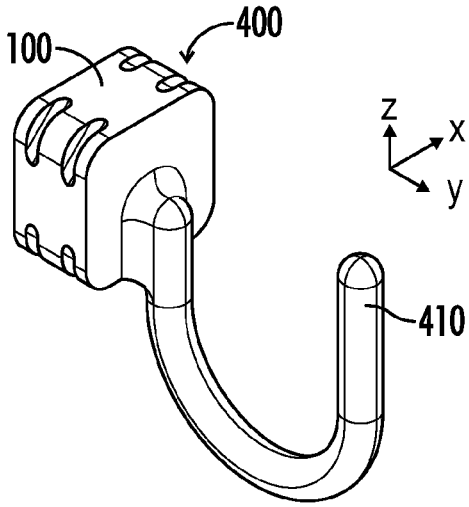
FIG. 8 depicts an exemplary embodiment of a holding apparatus having a hook.

FIG. 8 depicts an exemplary embodiment of a holding apparatus 400 having a hub 100 and a holding element 410 formed in the shape of a hook. The holding element 410 may be used for hanging clothing, such as a jacket, sport's equipment, or other objects. Like the holding apparatus 300, the components of the holding apparatus 400 may form a unitary structure or may be defined by separate structures that are attached to one another.

Figure 9:
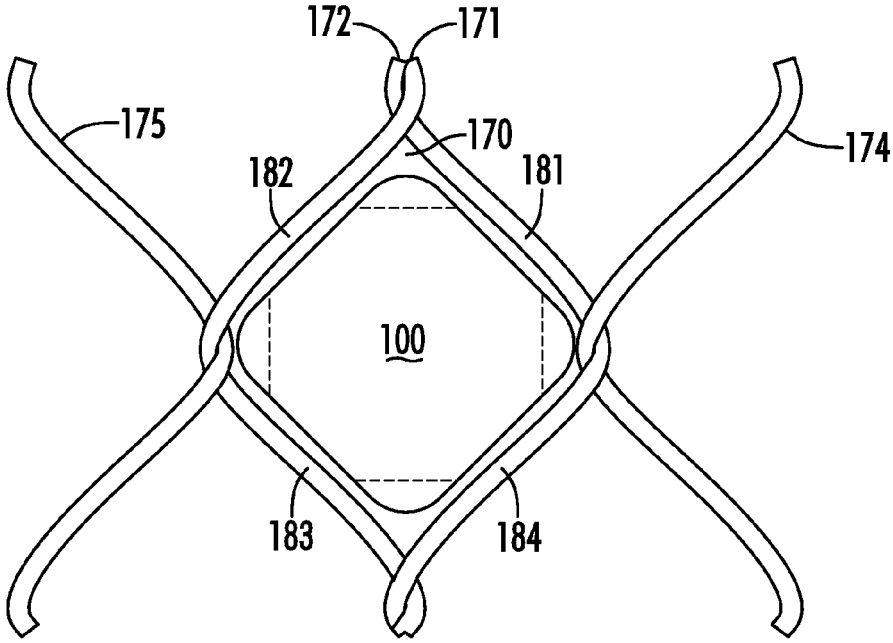
FIG. 9 depicts the hub of FIG. 1 inserted for attachment into an exemplary structure of a fabric of a chain link fence.
Figure 10:
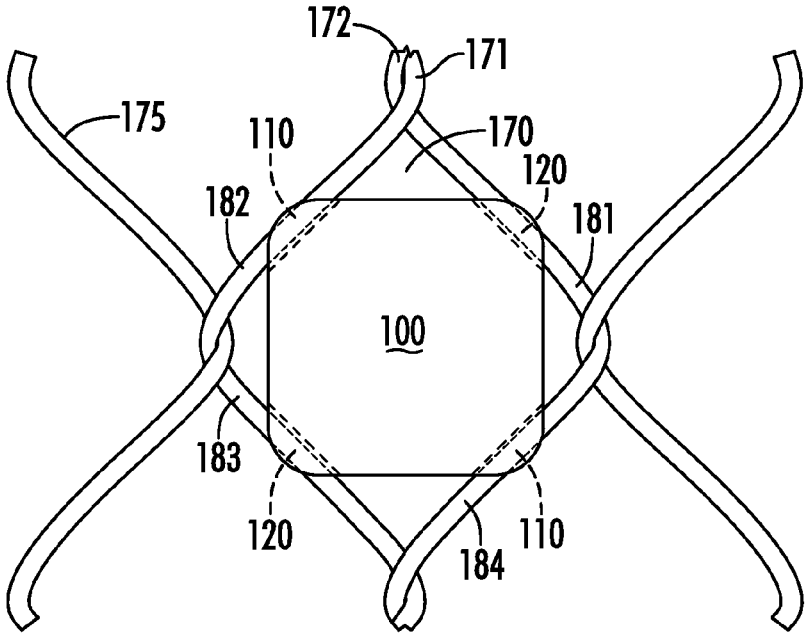
FIG. 10 depicts the hub of FIG. 1 inserted and attached into an exemplary structure of a fabric of a chain link fence.

FIGS. 9 and 10 show how the hub 100 is coupled to the fabric of a chain link fence. As shown by FIG. 9, the hub 100 aligned with a cell 170 of the chain link fence so that the hub 100 can be inserted into the cell 170. In this regard, the hub 100 is oriented such that each corner of the hub 100 is aligned with a respective corner of the cell 170. Once the hub 100 is aligned with the cell 170, the hub 100 is inserted into the cell 170, and the depth of the insertion of the hub 100 is such that the front grooves 110 are aligned with the wire segments 182 and 184. The offset dimension between the front grooves 110 and the back grooves 120 is such that the back grooves 120 are simultaneously aligned with the wire segments 181 and 183 of the cell 170. In this regard, the offset of the back grooves 120 relative to the front grooves 110 matches the offset of the wire segments 182 and 184 relative to the wire segments 181 and 183.

After insertion of the hub 100 into the cell 170, the hub 100 is rotated, around 45 degrees, until the segments 182 and 184 are respectively inserted into a pair of the front grooves 110 and the segments 181 and 183 are respectively inserted into a pair of the back grooves 120, as shown by FIG. 10. Insertion of the segments 182 and 184 into the front grooves 110 and of the segments 181 and 183 into the back grooves 120 secures the hub 100 to the fence. In this regard, the segments 181-184 hold the hub 100 and the walls of the grooves into which the segments 181-184 are inserted keep the hub 100 from falling out of the fence fabric.

Note that a pair of the front grooves 110 and a pair of the back grooves 120 are unoccupied in FIG. 10. Such grooves, however, receive the segments 181-184 when the orientation of the fence is reversed relative to the orientation shown by FIG. 5, as described above.

To remove the hub 100 from the cell 170, the hub 100 is rotated back to the position shown by FIG. 9. In this regard, as the hub 100 is rotated, the segments 181-184 pass out of the grooves 110 and 120 such that the hub 100 is no longer held by the segments 181-184. Once the hub 100 is again aligned with the cell 170, as shown by FIG. 9, the hub 100 may be pulled from the cell 170.

Figure 11:
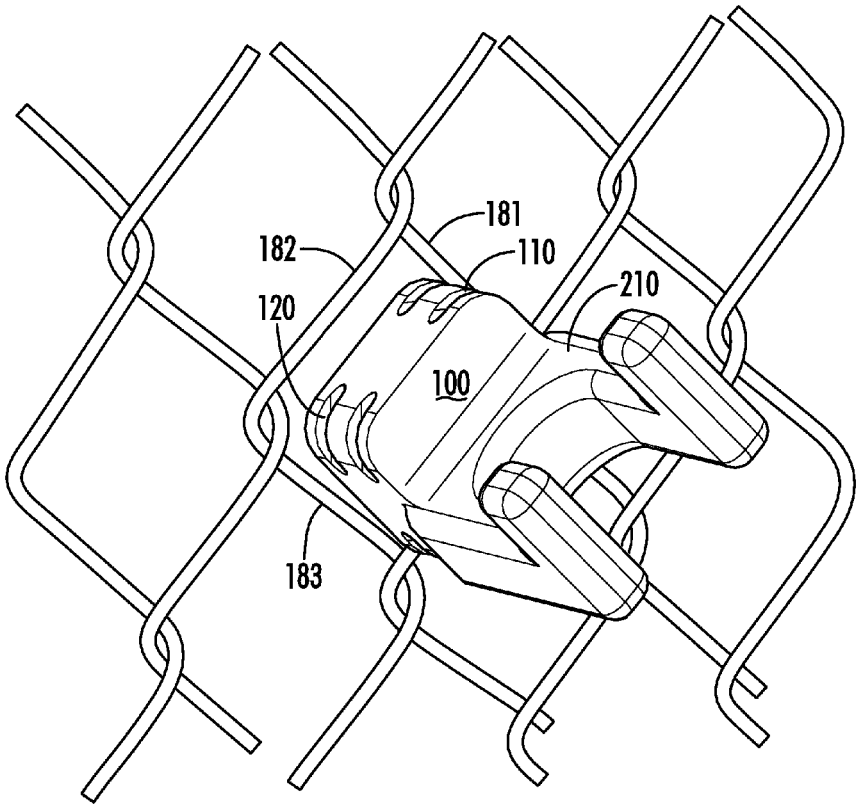
FIG. 11 depicts an exemplary embodiment of a holding apparatus, such as is depicted by FIG. 7, aligned for insertion into a fabric of a chain link fence.
Figure 12:
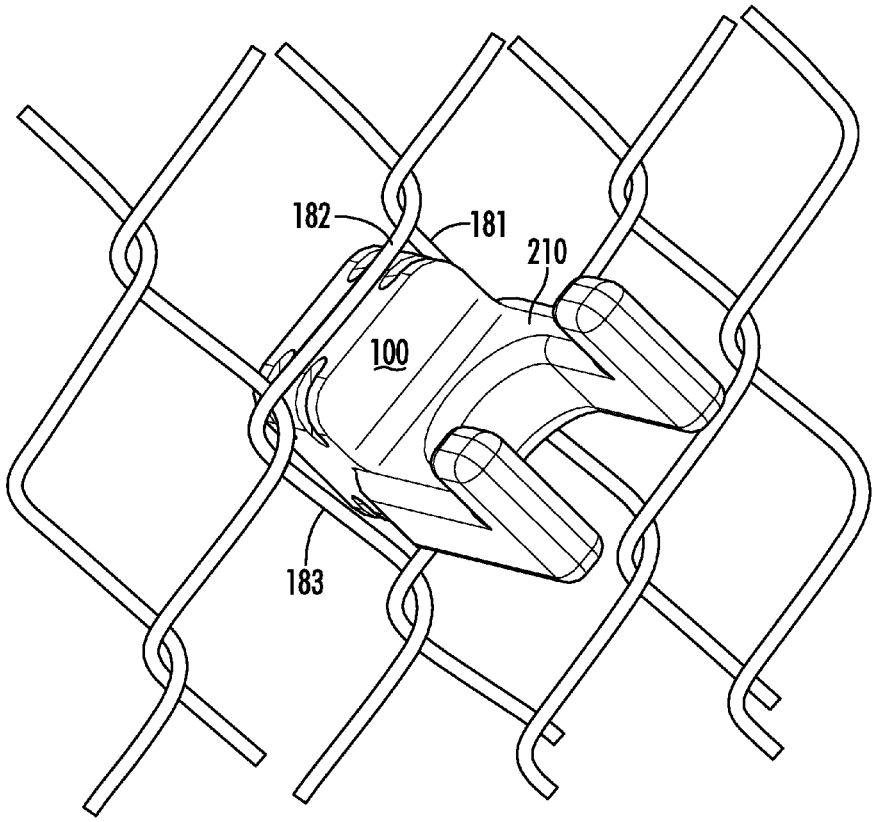
FIG. 12 depicts the holding apparatus of FIG. 7 after a hub of the holding apparatus has been inserted into the fabric of a chain link fence.
Figure 13:
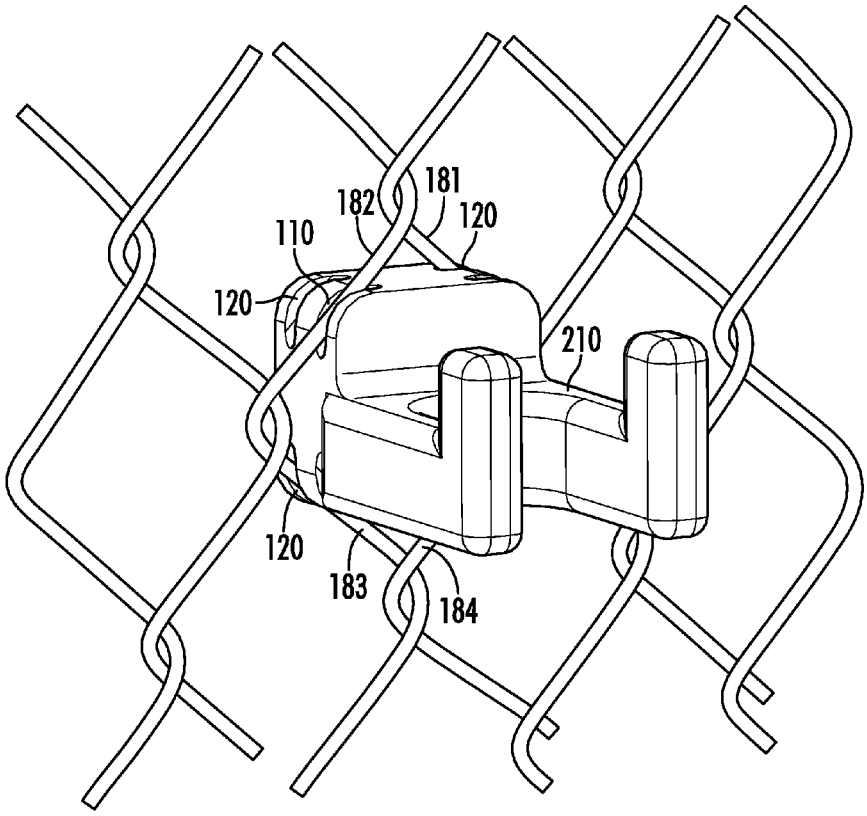
FIG. 13 depicts the holding apparatus of FIG. 7 after the holding apparatus has been rotated to secure the holding apparatus to a chain link fence.
Figure 14:
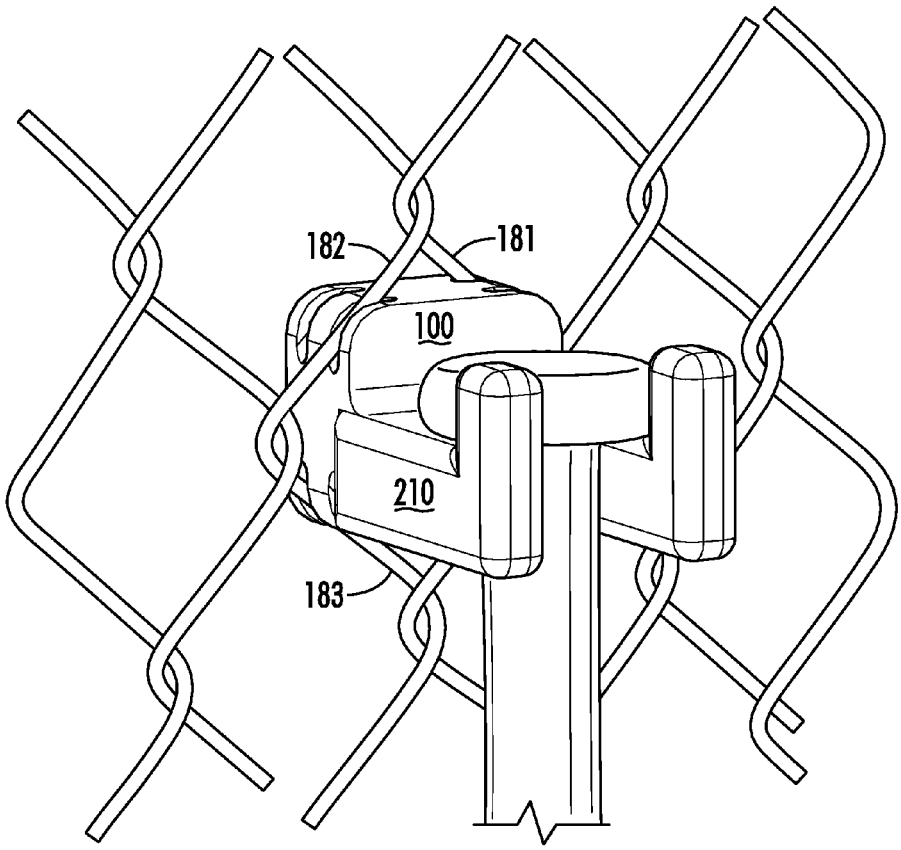
FIG. 14 depicts the holding apparatus of FIG. 7 while it is holding a bat.

FIGS. 11-13 show the holding apparatus 200 being attached to a chain link fence. The holding apparatus 200 is positioned for insertion into a diamond-shaped cell 170 of the fence fabric, as shown in FIG. 11. Then, the holding apparatus 200 is aligned with the cell 170 and inserted into the cell 170 for rotation as shown in FIG. 12. After the holding apparatus 200 is rotated, it is firmly attached to the fence and has an orientation as shown in FIG. 13. A view of the apparatus 200 holding a bat is shown in FIG. 14.

Hub 100 may be used as an element of other holding apparatuses having other holding elements extending from the hub 100. For example, the bat holding element 200 with a notch 220 may be used to hold a tennis racket by widening the notch 220. A holding element attached to hub 100 could have a U-shaped channel and thereby capable of holding a placard, book or similarly shaped article.

It should be emphasized that the above-described embodiments of the present disclosure are merely examples of implementations, set forth for a clear understanding of the principles of the disclosure. Many variations and modifications may be made to the above-described embodiments of the disclosure without departing substantially from the spirit and principles of the invention. All such modifications and variations are intended to be included herein within the scope of this disclosure and the present invention and protected by the following claims.

The invention claimed is:

1. A method for holding articles, comprising:

inserting a hub of a holding apparatus into a cell of a chain link fence, the hub having a first groove and a second groove offset from the first groove;

securing the hub to the cell, the securing comprising rotating the hub in the cell such that a first wire of the cell is received by the first groove and a second wire of the cell is received by the second offset groove, wherein the first wire has a first wire segment, wherein the second wire has a second wire segment, wherein the cell is defined by the first wire segment, the second wire segment, a third wire segment, and a fourth wire segment, wherein the first wire segment is opposite of the third wire segment, wherein the second wire segment is opposite of the fourth wire segment, wherein the hub has a third groove and a fourth groove that is offset from the third groove, and wherein the securing is performed such that the third wire segment is received by the third groove and the fourth wire segment is received by the fourth groove; and positioning an article on the holding apparatus while the hub is secured to the cell.

2. The method of claim 1, wherein the holding apparatus has a first arm and a second arm separated by a gap, wherein the article is a bat, and wherein the positioning comprises positioning the bat between the first and second arms.

3. The method of claim 1, wherein the first wire is intertwined with the second wire at a corner of the cell.

4. A method for holding articles, comprising:

inserting a hub of a holding apparatus into a cell of a chain link fence, the cell defined by a first wire segment, a second wire segment, a third wire segment, and a fourth wire segment, wherein the first wire segment is intertwined with the second wire segment at a first corner of the cell, wherein the second wire segment is intertwined with the third wire segment at a second corner of the cell, wherein the third wire segment is intertwined with the fourth wire segment at a third corner of the cell, and wherein the fourth wire segment is intertwined with the first wire segment at a fourth corner of the cell;

securing the hub to the cell, the securing comprising rotating the hub in the cell such that the first and second wire segments are received by grooves of the hub, wherein the securing is performed such that third and fourth wire segments are received by the grooves of the hub; and positioning an article on the holding apparatus while the hub is secured to the cell.

5. The method of claim 4, wherein the first wire segment is parallel to the third wire segment, and wherein the second wire segment is parallel to the fourth wire segment.

6. The method of claim 4, wherein the first and third wire segments are within a first plane, wherein the second and fourth wire segments are within a second plane, and wherein the first and second planes are offset.

* * * * *